US009096968B1

(12) United States Patent
Munoz et al.

(10) Patent No.: US 9,096,968 B1
(45) Date of Patent: Aug. 4, 2015

(54) PORTABLE CLOTHESLINE SYSTEM FOR HEAVY GARMENTS

(71) Applicants: Moses Munoz, Bell Gardens, CA (US); Laura Franco, Bell Gardens, CA (US)

(72) Inventors: Moses Munoz, Bell Gardens, CA (US); Laura Franco, Bell Gardens, CA (US)

( * ) Notice: Subject to any disclaimer, the term of this patent is extended or adjusted under 35 U.S.C. 154(b) by 0 days.

(21) Appl. No.: 14/459,585

(22) Filed: Aug. 14, 2014

(51) Int. Cl.
*D06F 53/02* (2006.01)

(52) U.S. Cl.
CPC ..... *D06F 53/02* (2013.01)

(58) Field of Classification Search
CPC ..... D06F 53/00; D06F 53/04; D06F 53/045; D06F 57/00; D06F 57/02; D06F 57/06; D06F 53/02
USPC ..... 211/85.24, 119.01–119.18, 123, 133.4, 211/182, 196, 197, 204–206
See application file for complete search history.

(56) References Cited

U.S. PATENT DOCUMENTS

| | | | | | |
|---|---|---|---|---|---|
| 382,269 | A | * | 5/1888 | Price | 211/119.09 |
| 490,380 | A | * | 1/1893 | Ward | 211/195 |
| 820,815 | A | * | 5/1906 | McManus | 211/119.17 |
| 985,485 | A | * | 2/1911 | Willard | 211/119.1 |
| 1,220,713 | A | * | 3/1917 | Anderson | 211/119.16 |
| 1,373,967 | A | * | 4/1921 | Lofquist | 254/374 |
| 1,424,626 | A | * | 8/1922 | Dore et al. | 211/119.15 |
| 1,513,445 | A | * | 10/1924 | Cohrs | 211/119.15 |
| 1,710,514 | A | * | 4/1929 | Reichert | 248/188.1 |
| 2,040,746 | A | * | 5/1936 | Kniedler | 211/119.1 |
| 2,202,193 | A | * | 5/1940 | Preston | 211/119.15 |
| 2,283,987 | A | * | 5/1942 | Hammar | 52/295 |
| 2,284,770 | A | * | 6/1942 | Clemens | 248/158 |
| 2,346,222 | A | * | 4/1944 | Knourek | 211/119.16 |
| 2,448,310 | A | * | 8/1948 | Hansen | 211/119.15 |
| 2,464,575 | A | * | 3/1949 | Henry | 211/119.15 |
| 2,487,527 | A | * | 11/1949 | Preston et al. | 211/119.16 |
| 2,558,410 | A | * | 6/1951 | Andersen | 211/119.01 |
| 2,559,130 | A | * | 7/1951 | Miller | 211/119.15 |
| 2,565,433 | A | | 8/1951 | Knight et al. | |
| 2,712,368 | A | * | 7/1955 | Mertz | 52/151 |
| 2,865,514 | A | | 12/1958 | Goodman | |
| 3,021,091 | A | | 2/1962 | Swanson | |
| 3,139,190 | A | * | 6/1964 | Shore | 211/197 |
| 3,215,279 | A | * | 11/1965 | Leo | 211/119.15 |
| 3,743,105 | A | * | 7/1973 | David | 211/153 |
| 4,434,898 | A | * | 3/1984 | McCarthy | 211/1.3 |
| 4,592,472 | A | | 6/1986 | Carnera | |
| D309,928 | S | | 8/1990 | Thomas | |
| 5,090,578 | A | | 2/1992 | Arnold | |
| 7,717,391 | B2 | | 5/2010 | Roberts | |
| 7,866,494 | B1 | * | 1/2011 | Emile | 211/196 |
| 2005/0116128 | A1 | * | 6/2005 | Wang | 248/219.3 |

FOREIGN PATENT DOCUMENTS

| | | | | |
|---|---|---|---|---|
| EP | 1306480 | A1 * | 5/2003 | D06F 57/06 |

* cited by examiner

*Primary Examiner* — Joshua Rodden

(57) ABSTRACT

A portable clothesline system for helping to dry garments, heavy rugs, or blankets featuring a pair of vertical bars positioned parallel to each other and supported by tapered bases and a pair of horizontal bars attached to the top ends of the vertical bars. The horizontal bars are connected via a plurality of wires that extend from one horizontal bar to the other. The wires are secured to the horizontal bars via slots with perforations.

1 Claim, 6 Drawing Sheets

PORTABLE CLOTHESLINE SYSTEM FOR HEAVY GARMENTS

FIELD OF THE INVENTION

The present invention relates to clotheslines, more particularly to a portable clothesline system that can accommodate heavy garments such as rugs and blankets.

BACKGROUND OF THE INVENTION

Dry-cleaning or professional cleaning of heavy garments (e.g., rugs, blankets, comforters) is expensive. The present invention features a portable clothesline system for helping to dry garments or other items, such as heavy rugs or blankets, outdoors. The system of the present invention is portable, so it can easily be moved from shaded areas to sunny areas, or even indoor.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

SUMMARY OF THE INVENTION

The present invention features a portable clothesline system (100) for helping to dry garments. In some embodiments, the system (100) comprises a first vertical bar (110) and a second vertical bar (210), the vertical bars (110) are oriented in a vertical manner and positioned parallel to each other, each vertical bar (110, 210) has a top end (111) and a bottom end (112), wherein threads (180) are disposed on both the top end (111) and bottom end (112) of both vertical bars (110, 210); a first horizontal bar (120) disposed at the top end (111) of the first vertical bar (110) and a second horizontal bar (220) disposed at the top end (111) of the second vertical bar (210), threads (180) are disposed in bottom surfaces (122) of the horizontal bars (120, 220), wherein threads (180) of the top end (111) of the first vertical bar (110) engage threads of the first horizontal bar (120) to attach the first vertical bar (110) to the first horizontal bar (120), and threads (180) of the top end (111) of the second vertical bar (210) engage threads of the second horizontal bar (220) to attach the second vertical bar (210) to the second horizontal bar (220), wherein a plurality of slots (150) is disposed in top surfaces (121) of the horizontal bars (120, 220), a perforation (152) is disposed at a base area of each slot (150); a first base (130) disposed at the bottom end (112) of the first vertical bar (110) and a second base (230) disposed at the bottom end (112) of the second vertical bar (210), threads (180) are disposed in top surfaces (131) of the bases (130, 230), wherein threads (180) of the bottom end (112) of the first vertical bar (110) engage threads of the first base (130) to attach the first vertical bar (110) to the first base (130), and threads (180) of the bottom end (112) of the second vertical bar (210) engage threads of the second base (230) to attach the second vertical bar (210) to the second base (230), the bases (130, 230) are tapered such that bottom surfaces (132) of the bases (130, 230) are wider than the top surfaces (131) of the bases (130, 230); and wires (160) extending from the first horizontal bar (120) to the second horizontal bar (220), each wire is attached to a perforation (152) of a slot (150) in the first horizontal bar (120) and to a perforation (152) of a slot (150) in the second horizontal bar (220), the perforations (152) help secure the wires (160) in the slots (150).

DESCRIPTION OF PREFERRED EMBODIMENTS

Figure 1:
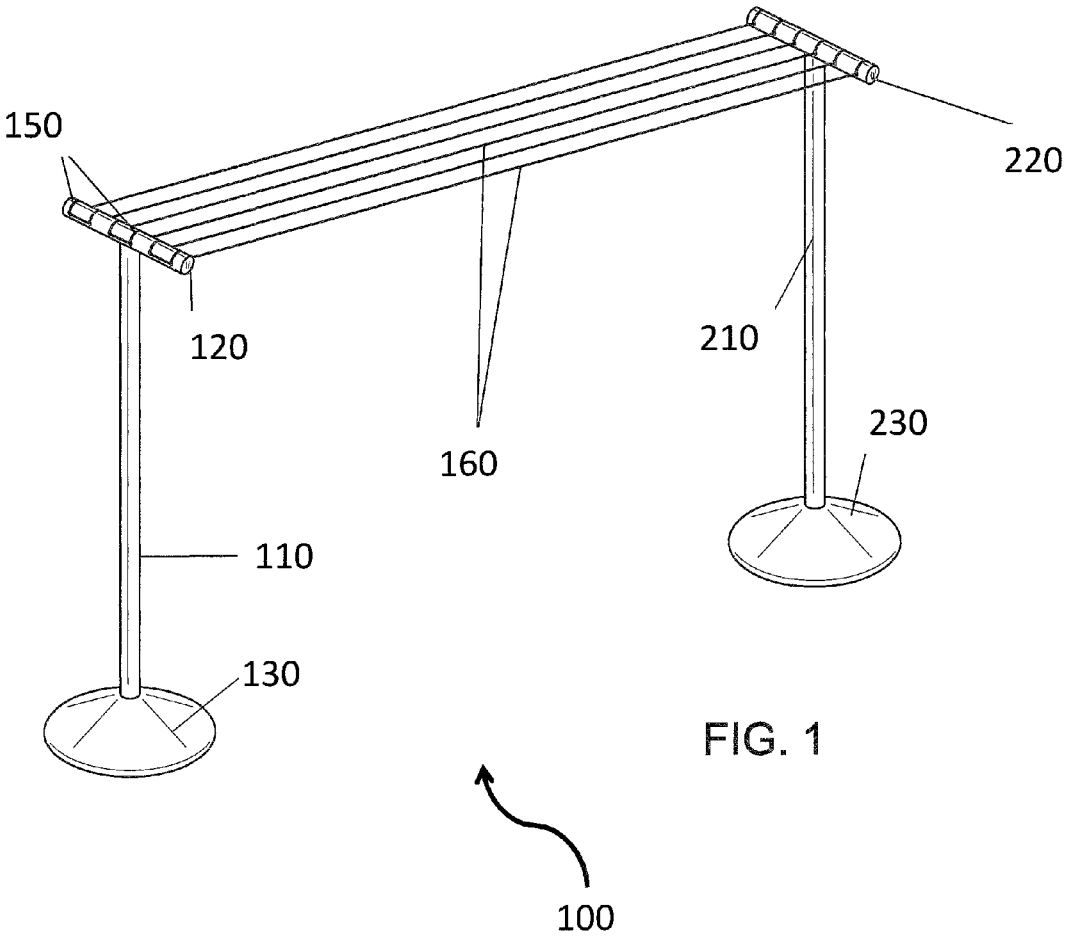
FIG. 1 shows a perspective view of the system of the present invention.

Following is a list of elements corresponding to a particular element referred to herein:

100 clothesline system
110 first vertical bar
111 top ends of vertical bars
112 bottom ends of vertical bars
120 first horizontal bar
121 top surfaces of horizontal bars
122 bottom surfaces of horizontal bars
130 first base
131 top surfaces of bases
132 bottom surfaces of bases
150 slots
152 perforations in slots
160 wires (e.g., steel)
161 first end of wire
162 second end of wire
180 threads
210 second vertical bar
220 second horizontal bar
230 second base Referring now to FIG. 1-5, the present invention features a portable clothesline system (100) for helping to dry garments or other items, such as heavy rugs or blankets, outdoors. The system (100) of the present invention is portable, so it can easily be moved from shaded areas to sunny areas, or even indoor.

Figure 5:
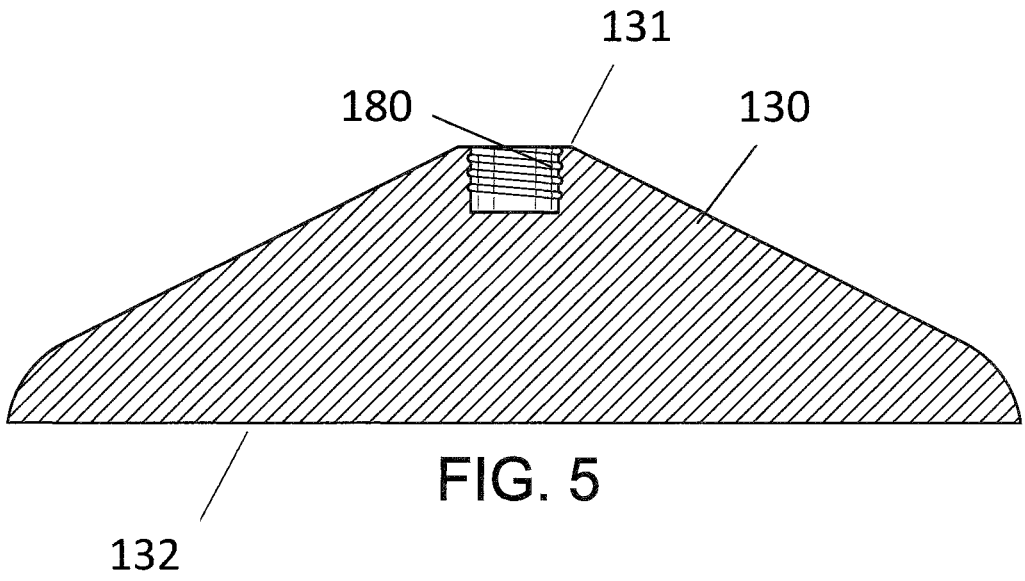
FIG. 5 shows a cross sectional view of the system of FIG. 3.

The system (100) comprises a first vertical bar (110) and a second vertical bar (210). The vertical bars (110) are oriented in a vertical manner and positioned parallel to each other. Disposed at the bottom end (112) of the first vertical bar (110) is a first base (130). Disposed at the bottom end (112) of the second vertical bar (210) is a second base (230). The bases (130, 230) help keep the vertical bars (110, 210) upright. As shown in FIG. 5, the bases (130, 230) are tapered such that the bottom surfaces (132) of the bases (130, 230) are wider than the top surfaces (131) of the bases (130, 230).

Figure 2:
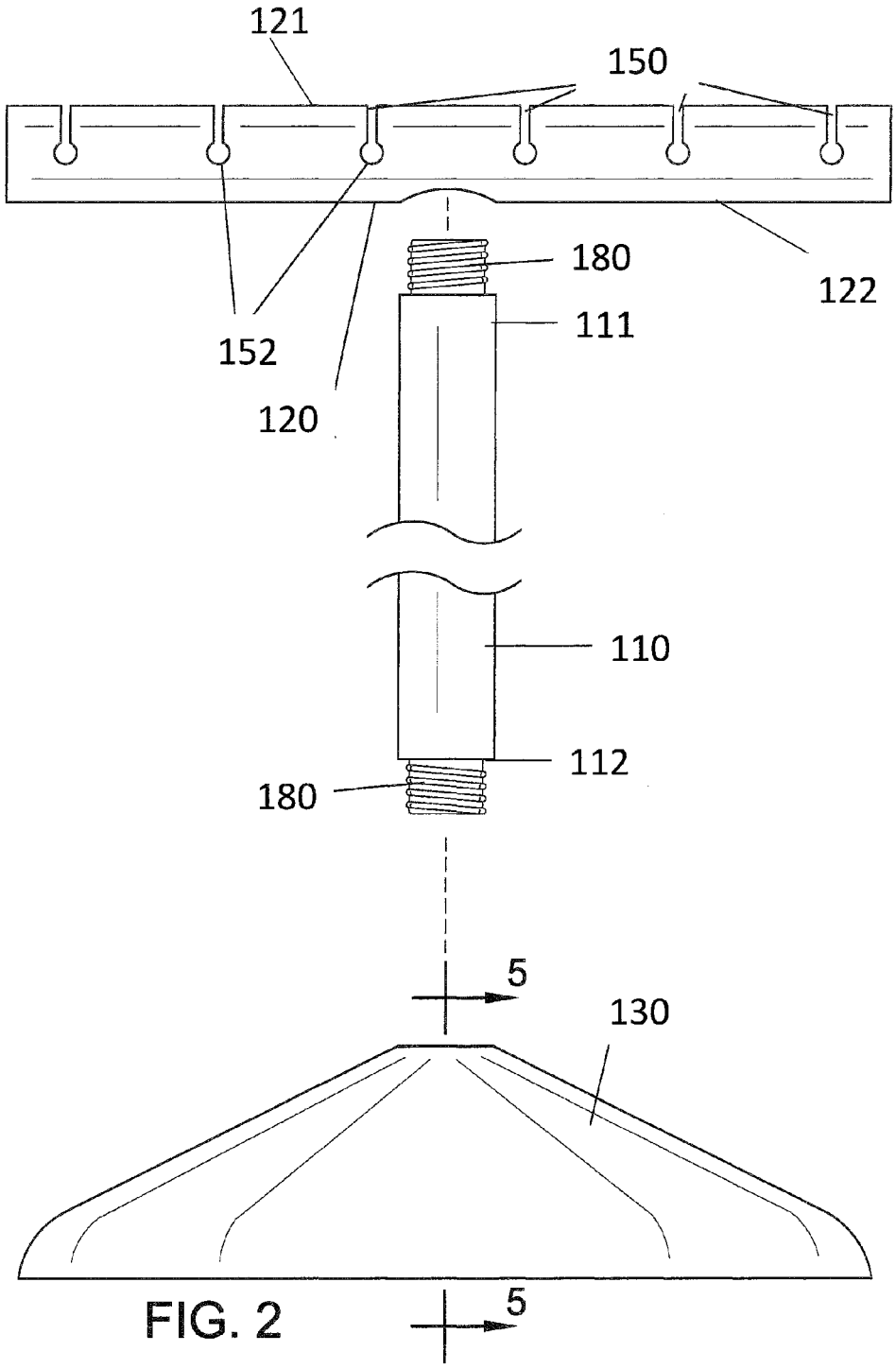
FIG. 2 shows a detailed view of the system of the present invention.
Figure 3:
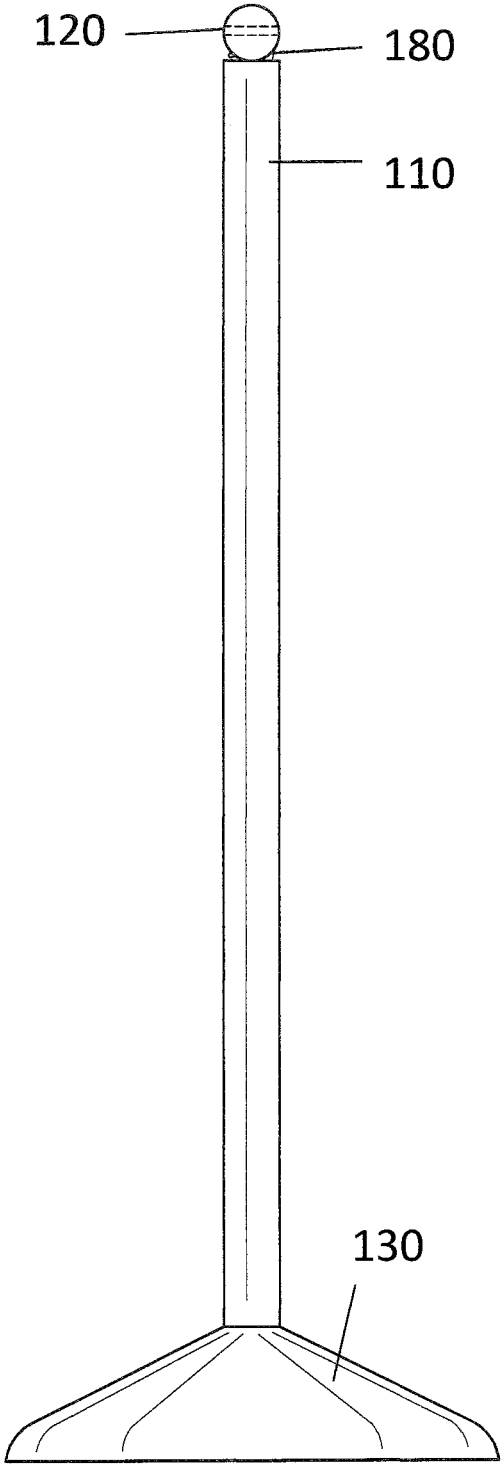
FIG. 3 shows a side view of the system of the present invention.

As shown in FIG. 2, threads (180) are disposed at the bottom ends (112) of the vertical bars (110, 210). Threads (180) are also disposed in the top surfaces (131) of the bases (130, 230). The threads (180) of the vertical bars (110, 210) engage the threads (180) of the bases (130, 230) to attach the vertical bars (110, 210) to the bases (130, 230). The bases (130, 230) are strong and solid so as to provide stability to the system (100).

The system (100) further comprises a first horizontal bar (120) that attaches to the top end (111) of the first vertical bar (110) and a second horizontal bar (220) that attaches to the top end (111) of the second vertical bar (210). As shown in FIG. 2, threads (180) are disposed at the top ends (111) of the vertical bars (110, 210). Threads (180) are also disposed in horizontal bars (120, 220) (e.g., in the bottom surfaces (122) of the horizontal bars (120, 220). The threads (180) of the vertical bars (110, 210) engage the threads (180) of the horizontal bars (120, 220) to attach the vertical bars (110, 210) to the horizontal bars (120, 220).

The vertical bars (110, 210) and the horizontal bars may be constructed in a variety of sizes. For example, in some embodiments, the vertical bars (110, 210) are between about 3 to 5 feet in length from the top end (111) to the bottom end (112). In some embodiments, the vertical bars (110, 210) are between about 5 to 7 feet in length from the top end (111) to the bottom end (112). The system (100) of the present invention is not limited to the aforementioned dimensions.

The first horizontal bar (120) is connected to the second horizontal bar (220) via wires (160), e.g., steel wires. A plurality of slots (150) is disposed in the top surfaces (121) of the horizontal bars (120, 220). At the base of each slot (150) is a perforation (152). A wire (160) is placed in a slot (150) and into its perforation (152) in the first horizontal bar (120) and extended to a corresponding slot (150) (and its perforation (152)) in the second horizontal bar (220). The perforations (152) help secure the wires (160) in the slots (150).

Figure 4:
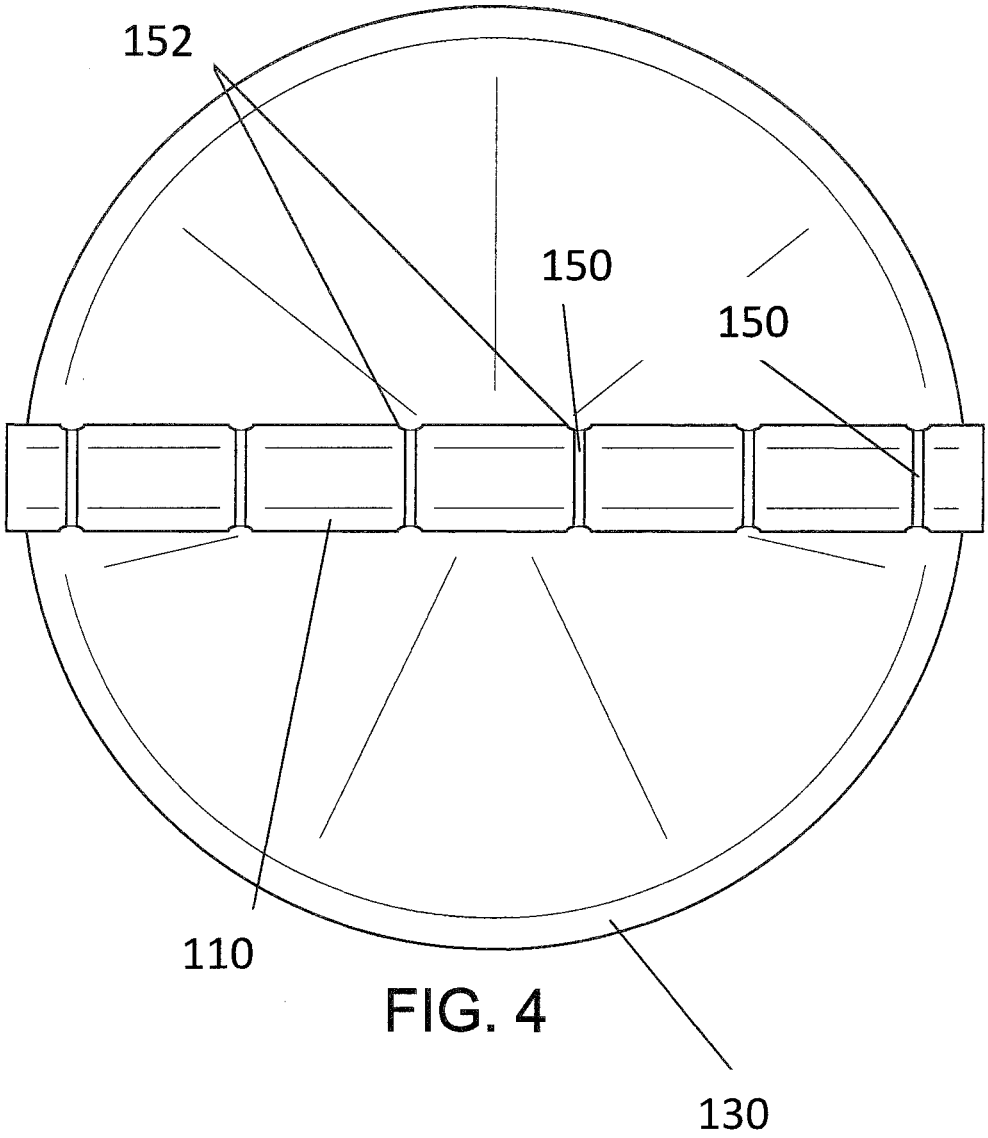
FIG. 4 shows a top view of the system of FIG. 3.
Figure 4A:
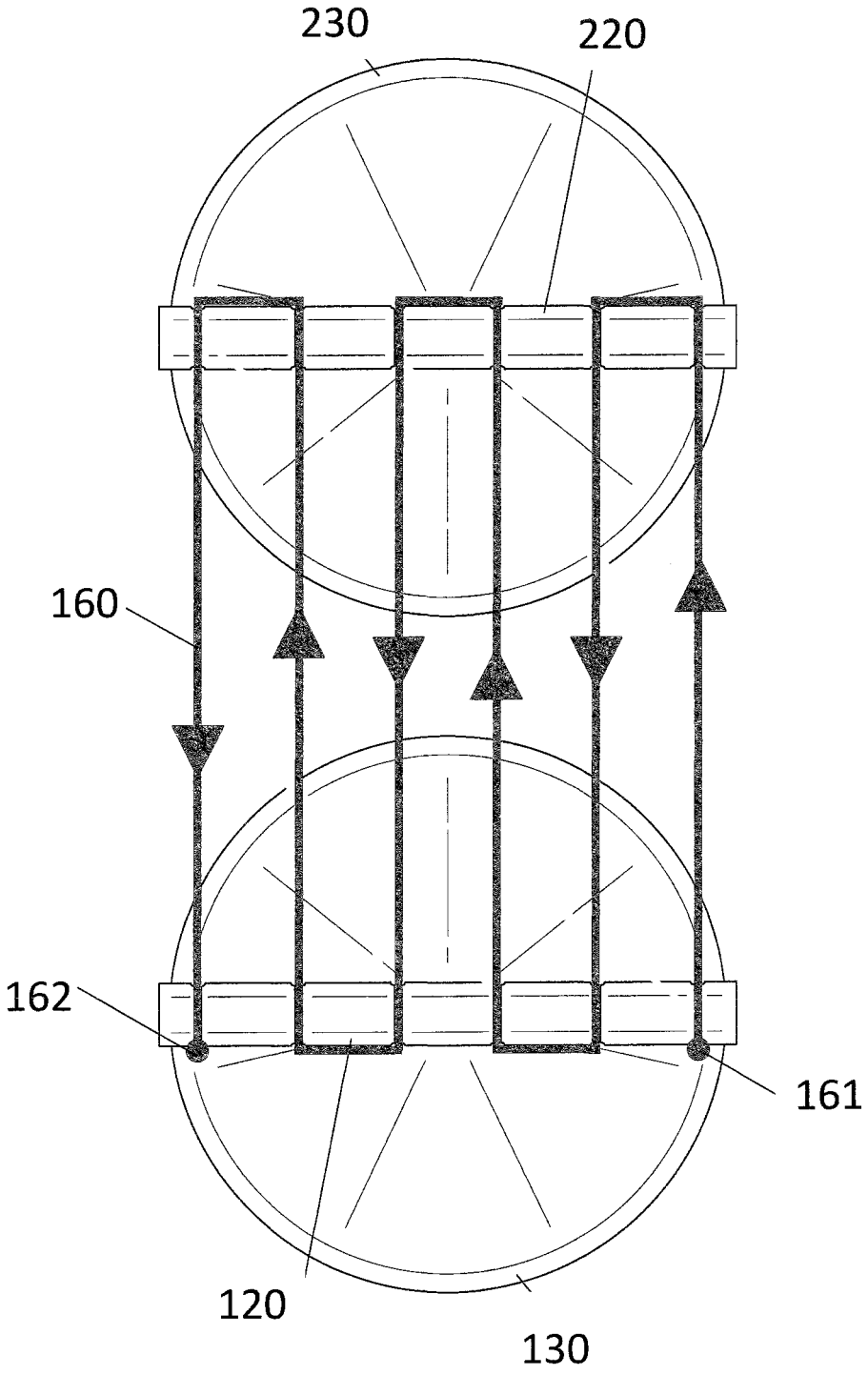
FIG. 4A shows a detailed view of the wire connecting the two horizontal bars.

As shown in FIG. 4A, the wire (160) can be attached by tying the first end (161) in one of the slots (150) in the first horizontal bar (120), e.g., the outermost slot. Then, the wire can be strung across to the second horizontal bar (220) and fed through the slot (150) opposite the slot to which the wire was tied. Then, the wire can be wrapped around and fed through an adjacent slot in the second horizontal bar (220), and strung across to a slot (the corresponding slot) in first horizontal bar (120). Then, the stringing of the wire can be continued until the last slot (150) where the second end (162) of the wire (160) can be tied to the horizontal bar. When the wire (160) is inserted into a slot (150), the wire (160) can be pushed further down into the perforation (152), which helps secure the wire (160) in place.

In some embodiments, wheels are disposed on the bottom surfaces (132) of the bases (130, 230).

As used herein, the term "about" refers to plus or minus 10% of the referenced number.

The disclosures of the following U.S. Patents are incorporated in their entirety by reference herein: U.S. Pat. No. 2,565,433; U.S. Pat. No. 2,865,514; U.S. Pat. No. 3,021,091; U.S. Pat. No. 4,592,472; U.S. Pat. No. 5,090,578; U.S. Pat. No. 7,717,391; U.S. Design Pat. No. 309,928.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims. Reference numbers recited in the claims are exemplary and for ease of review by the patent office only, and are not limiting in any way. In some embodiments, the figures presented in this patent application are drawn to scale, including the angles, ratios of dimensions, etc. In some embodiments, the figures are representative only and the claims are not limited by the dimensions of the figures. In some embodiments, descriptions of the inventions described herein using the phrase "comprising" includes embodiments that could be described as "consisting of", and as such the written description requirement for claiming one or more embodiments of the present invention using the phrase "consisting of" is met.

The reference numbers recited in the below claims are solely for ease of examination of this patent application, and are exemplary, and are not intended in any way to limit the scope of the claims to the particular features having the corresponding reference numbers in the drawings.

What is claimed is:

1. A portable clothesline system (100) for helping to dry garments, said system (100) consisting of:

(a) a first vertical bar (110) and a second vertical bar (210), the vertical bars (110, 210) are oriented in a vertical manner and positioned parallel to each other, each vertical bar (110, 210) has a top end (111) and a bottom end (112), wherein threads (180) are disposed on both the top end (111) and bottom end (112) of both vertical bars (110, 210);

(b) a first horizontal bar (120) disposed at the top end (111) of the first vertical bar (110) and a second horizontal bar (220) disposed at the top end (111) of the second vertical bar (210), threads (180) are disposed in bottom surfaces (122) of the horizontal bars (120, 220), wherein the threads (180) of the top end (111) of the first vertical bar (110) engage the threads of the first horizontal bar (120) to attach the first vertical bar (110) to the first horizontal bar (120), and the threads (180) of the top end (111) of the second vertical bar (210) engage the threads of the second horizontal bar (220) to attach the second vertical bar (210) to the second horizontal bar (220), wherein a plurality of slots (150) is disposed in top surfaces (121) of the horizontal bars (120, 220), a perforation (152) is disposed at a base area of each slot (150);

(c) a first base (130) disposed at the bottom end (112) of the first vertical bar (110) and a second base (230) disposed at the bottom end (112) of the second vertical bar (210), threads (180) are disposed in top surfaces (131) of the bases (130, 230), wherein the threads (180) of the bottom end (112) of the first vertical bar (110) engage the threads of the first base (130) to attach the first vertical bar (110) to the first base (130), and the threads (180) of the bottom end (112) of the second vertical bar (210) engage the threads of the second base (230) to attach the second vertical bar (210) to the second base (230), the bases (130, 230) are tapered such that bottom surfaces (132) of the bases (130, 230) are wider than the top surfaces (131) of the bases (130, 230); and (d) a wire (160) extending from the first horizontal bar (120) to the second horizontal bar (220), the wire is attached to the perforation (152) of one of the slots (150) in the first horizontal bar (120) and to the perforation (152) of one of the slots (150) in the second horizontal bar (220), the perforations (152) help secure the wire (160) in the slots (150);

wherein the wire (160) is attached by tying a first end (161) in one of the slots (150) in the first horizontal bar (120), the wire (160) is strung across to the second horizontal bar (220) and fed through the slot (150) opposite the slot to which the wire was tied, the wire is wrapped around and fed through an adjacent slot in the second horizontal bar (220), and strung across to a corresponding slot in first horizontal bar (120), wherein stringing of the wire continues until the last slot (150) where a second end (162) of the wire (160) is tied to the first horizontal bar (120).

* * * * *